US012566046B2

(12) United States Patent
Forestieri, Sr.

(10) Patent No.: US 12,566,046 B2
(45) Date of Patent: Mar. 3, 2026

(54) ARCHERY BOW RISERS AND BOW ACCESSORIES HAVING LEVELING DEVICES

(71) Applicant: LEVEL TECHNOLOGY SYSTEMS LLC, Florida, NY (US)

(72) Inventor: Andrew Forestieri, Sr., Monroe, NY (US)

(73) Assignee: LEVEL TECHNOLOGY SYSTEMS LLC, Florida, NY (US)

( * ) Notice: Subject to any disclaimer, the term of this patent is extended or adjusted under 35 U.S.C. 154(b) by 415 days.

(21) Appl. No.: 18/097,251

(22) Filed: Jan. 15, 2023

(65) Prior Publication Data

US 2024/0240916 A1 Jul. 18, 2024

(51) Int. Cl.
*F41G 1/467* (2006.01)

(52) U.S. Cl.
CPC ..... *F41G 1/467* (2013.01)

(58) Field of Classification Search
CPC ... F41G 1/467; F41G 1/44; F41G 1/54; F41B 5/148
USPC ..... 33/265, 301; 124/87, 88
See application file for complete search history.

(56) References Cited

U.S. PATENT DOCUMENTS 5,983,879 A * 11/1999 Gifford ..... F41B 5/1449 33/506
7,574,811 B2 * 8/2009 Kurtzhals ..... F41G 1/467 124/87
D842,141 S * 3/2019 Forestieri, Sr. ..... D10/69
2003/0088990 A1 * 5/2003 Henry ..... F41B 5/1449 33/506
2013/0036617 A1 * 2/2013 Wasilewski ..... F41G 1/467 33/265
2015/0300768 A1 * 10/2015 Forestieri, Sr. ..... G01C 9/28 33/301
2021/0325148 A1 * 10/2021 Jones ..... F41G 1/467
2024/0240916 A1 * 7/2024 Forestieri, Sr. ..... F41G 1/467

* cited by examiner

*Primary Examiner* — Peter J Macchiarolo
*Assistant Examiner* — Anna Josephine Saunders

(57) ABSTRACT

Archery bow risers and bow accessories are provided which comprise integrated level devices for use in, e.g., tuning and installing accessories on archery bows such as compound bows. For example, a bow sight device comprises a mounting bracket configured for attachment to a bow riser, and a sight housing adjustably connected to the mounting bracket. The mounting bracket comprises a first level device and a second level device. The first level device is configured to enable a user to level the bow riser in a first direction, when the bow sight device is attached to the bow riser. The second level device is configured to enable a user to level the bow riser and the sight housing in a second direction which is orthogonal to the first direction, when the bow sight device is attached to the bow riser.

20 Claims, 9 Drawing Sheets

ARCHERY BOW RISERS AND BOW ACCESSORIES HAVING LEVELING DEVICES

BACKGROUND

This disclosure generally relates to techniques for tuning archery bows such as compound bows. Bowhunting has become an increasingly popular form of recreational hunting. In the early days of bowhunting, hunters used traditional archery bows such as a longbow or a recurve bow. However, the introduction of the compound bow revolutionized the sport of archery and bowhunting, as the compound bow design has proven to be easy to use and can provide higher arrow velocity and precision arrow flight, as compared to traditional bows. In general, archery bows require frequent adjustment, repair, installment, and tuning of bow strings and peep sights, and other accessories such as arrow rests and sighting devices. When tuning an archery bow or installing accessories on an archery bow, it is important to maintain the archery bow in a level orientation. In particular, to ensure precise alignment and proper installation of accessories such as arrows rests, peep sights and sighting devices on a compound bow, for example, it is imperative to fixedly position the compound bow in a level vertical orientation prior to and during such installation.

SUMMARY

Embodiments of the disclosure generally include archery bow risers and bow accessories having integrated level devices for use in, e.g., tuning and installing accessories on archery bows such as compound bows.

For example, an exemplary embodiment includes a bow sight device which comprises a mounting bracket configured for attachment to a bow riser, and a sight housing adjustably connected to the mounting bracket. The mounting bracket comprises a first level device and a second level device. The first level device is configured to enable a user to level the bow riser in a first direction, when the bow sight device is attached to the bow riser. The second level device is configured to enable a user to level the bow riser and the sight housing in a second direction which is orthogonal to the first direction, when the bow sight device is attached to the bow riser.

Another exemplary embodiment includes an apparatus which comprises a bow riser, and a bow sight device mounted to the bow riser. The bow sight device comprises a mounting bracket attached to the bow riser, and a sight housing adjustably connected to the mounting bracket. The bow riser comprises a first level device that is configured to enable a user to level the apparatus in a first direction. The bow sight device comprises a second level device that is configured to enable the user to level the apparatus in a second direction, which is orthogonal to the first direction.

Another exemplary embodiment includes a method for tuning an archery bow, which comprises: mounting a bow sight device to bow riser to build an assembly of an archery bow, wherein the bow sight device comprises a first level device, and the bow riser comprises a second level device; utilizing the first level device to level the assembly in a first direction; utilizing the second level device to level the assembly in a second direction, which is orthogonal to the first direction; and performing at least one adjustment of the assembly with the assembly leveled in the first and second directions.

These and other embodiments of the disclosure will be described in the following detailed description of embodiments, which is to be read in conjunction with the accompanying figures.

DETAILED DESCRIPTION OF EMBODIMENTS

Figure 1:
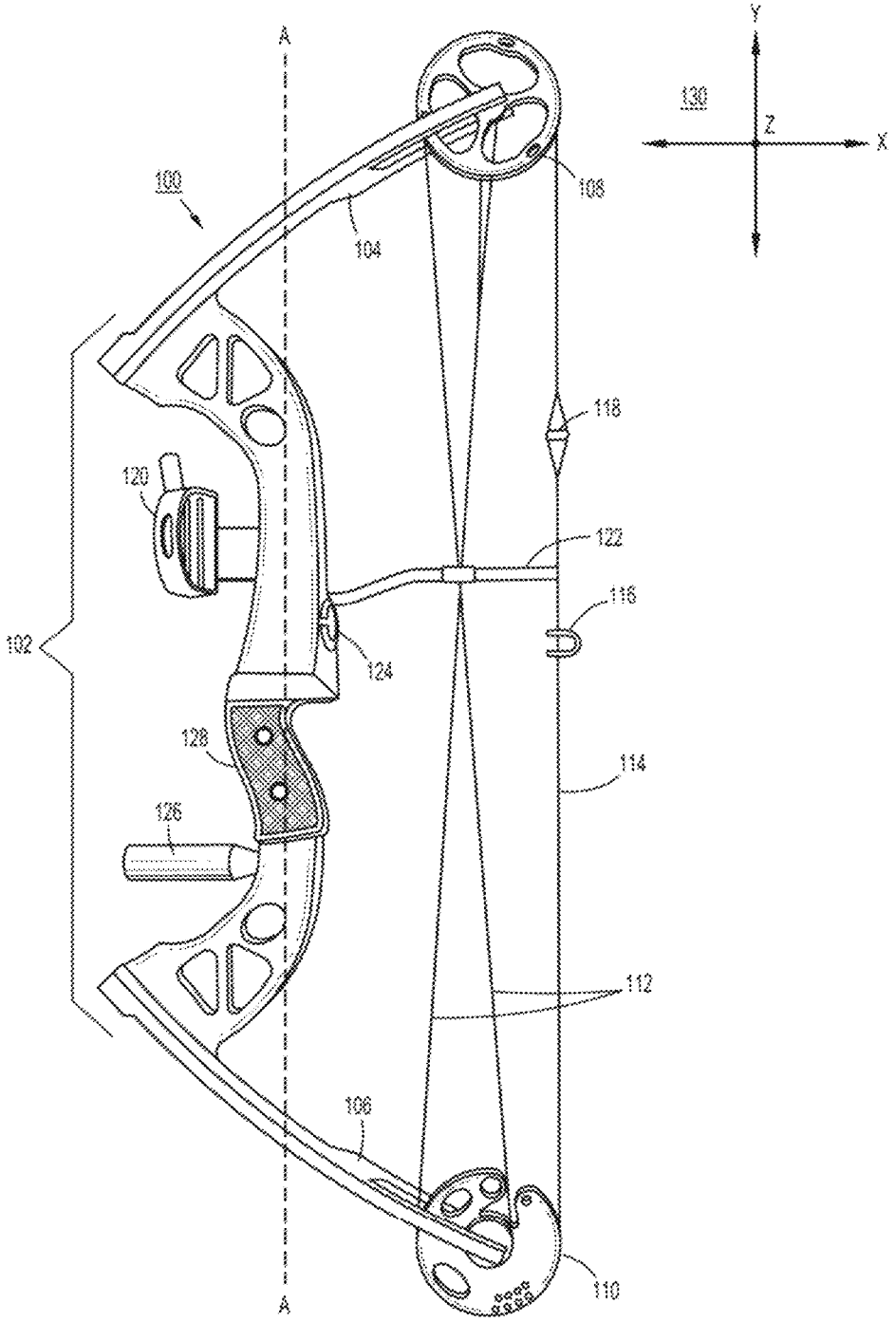
FIG. 1 illustrates an example of compound bow that can be tuned and accessorized using leveling devices and methods according to exemplary embodiments of the disclosure.

Embodiments of the disclosure will now be described in further detail with regard to archery bow risers and bow accessories having integrated level devices for use in, e.g., tuning and installing accessories on archery bows such as compound bows. For example, with initial reference to FIG. 1, an exemplary compound bow 100 is shown, which can be tuned and accessorized using leveling devices and methods according to exemplary embodiments of the disclosure. In general, the compound bow 100 comprises a bow riser 102, an upper limb 104 and lower limb 106 attached to opposite ends of the bow riser 102, upper and lower cam elements 108 and 110, cables 112, and a bow string 114. The bow string 114 includes a nocking loop 116 (e.g., D-loop), and a peep sight 118. Various accessories are attached to the bow riser 102 including, for example, a bow sight device 120, a cable guard 122, an arrow rest element 124, and a stabilizer device 126. The bow riser 102 comprises a grip region 128, which is held by an individual when using the compound bow 100. The functions of the various components of the compound bow 100 shown in FIG. 1 are well known in the art and, therefore, no detailed discussion is necessary for understanding the disclosure.

Briefly, the arrow rest element 124 is a device which is installed on the bow riser 102 and utilized to hold an arrow in place while the arrow is being drawn. The arrow rest element 124 helps stabilize the arrow while shooting the arrow, and reduces vibration of the arrow upon release of the arrow. There are different styles of arrow rests for bows including, e.g., a plunger style, a containment ring style, and a fall away style. The bow sight device 120 is a device that is utilized for accurately aiming an arrow. The bow sight device 120 can have a single sight pin to align with a target, or multiple sight pins that are used to align with a target for different distances.

The nocking loop 116 is a piece of cord that is attached by, e.g., cinch knots, to the bow string 144 at two points between a "nocking point" of the bow string 114. The nocking point is the point on the bow string 114 at which an arrow nock element (at an end portion of an arrow shaft) is placed on the bow string 114. With a D-loop type nocking loop 116, the nocking point on the bow string 114 is the point located between the two attachment points of the nocking loop 116 on the bow string 114. The predefined nocking point serves as a common point for placing the arrow nock of an arrow to achieve consistent results when shooting the arrows.

FIG. 1 further depicts a dashed line A-A which denotes a central longitudinal axis of the bow riser 102, as well as a three-axis coordinate system 130 including an X-axis, a Y-axis, and a Z-axis, which are all orthogonal in relation to each other. In FIG. 1, the X-axis and Y-axis are shown to extend orthogonal to each other in a 2D plane of the drawing, and the Z-axis is shown to extend in a direction in and out of the drawing. Moreover, FIG. 1 shows that the central longitudinal axis A-A of the bow riser 102 extends in the same direction as the Y-axis. In accordance with principles of the disclosure, when tuning the compound bow 100 or when installing accessories on the bow riser 102, it is desirable to maintain the bow riser 102 level in a vertical direction. By way of specific example, with regard to the coordinate system 130 shown in FIG. 1, the central longitudinal axis A-A of the bow riser 102 should be maintained level in the Y-axis direction. One method to position the central longitudinal axis A-A of the bow riser 102 in a level vertical orientation is to concurrently position both the X-axis and the Z-axis in a level horizontal orientation. Indeed, by principles of geometry, when the X-axis and the Z-axis are both leveled in a horizontal orientation, it necessarily follows that the Y-axis is level in a vertical orientation. These geometric concepts are implemented in accordance with embodiments of the disclosure which include inventive techniques for utilizing a bow riser and/or the bow sight device with integrated level devices for tuning an archery bow, e.g., determining a nocking point on the bow string, making bow sight adjustments, etc.

Figure 2A:
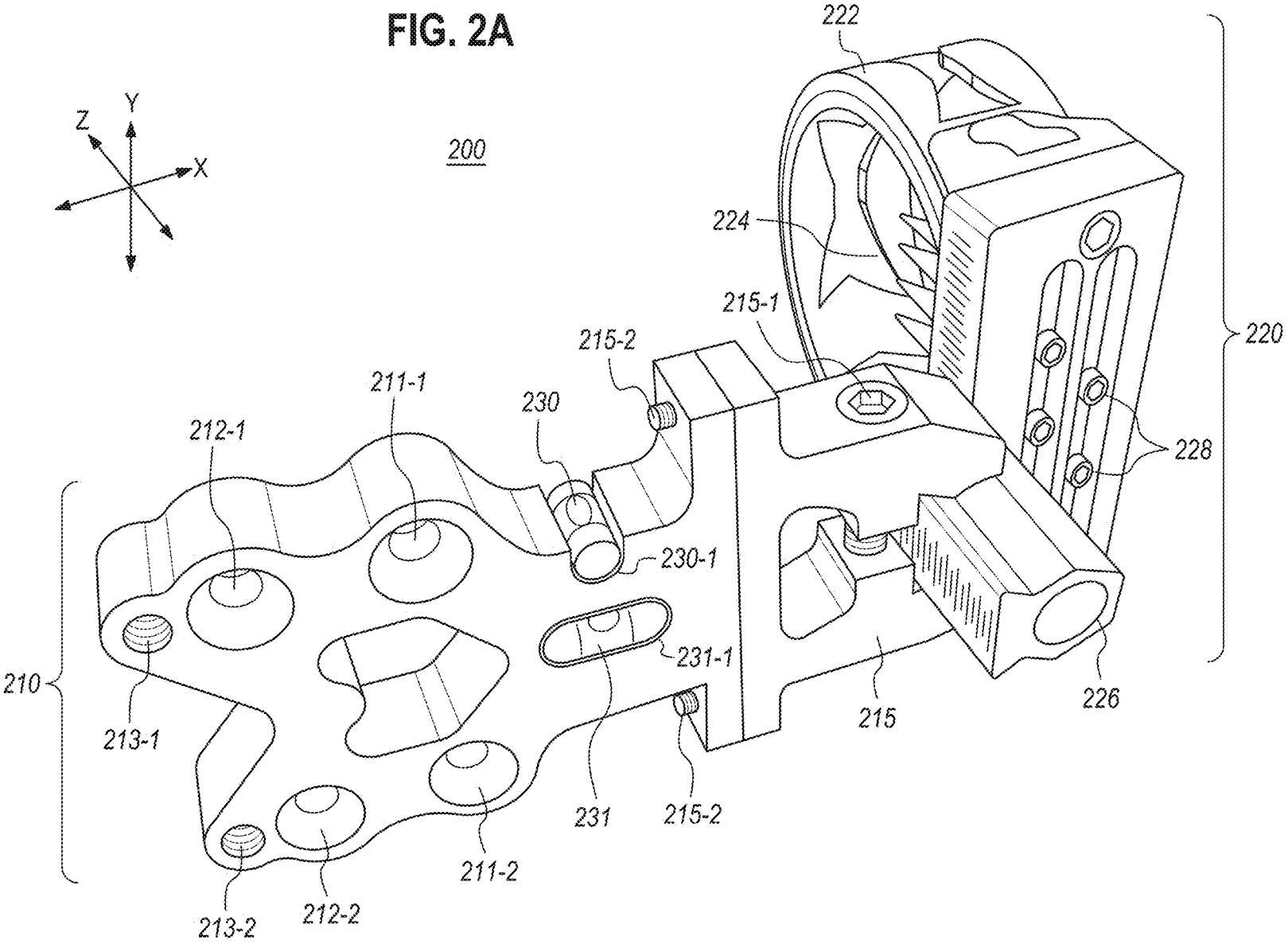
FIGS. 2A, 2B, and 2C are perspective views of a bow sight device with one or more integrated level devices, according to an exemplary embodiment of the disclosure.
Figure 2B:
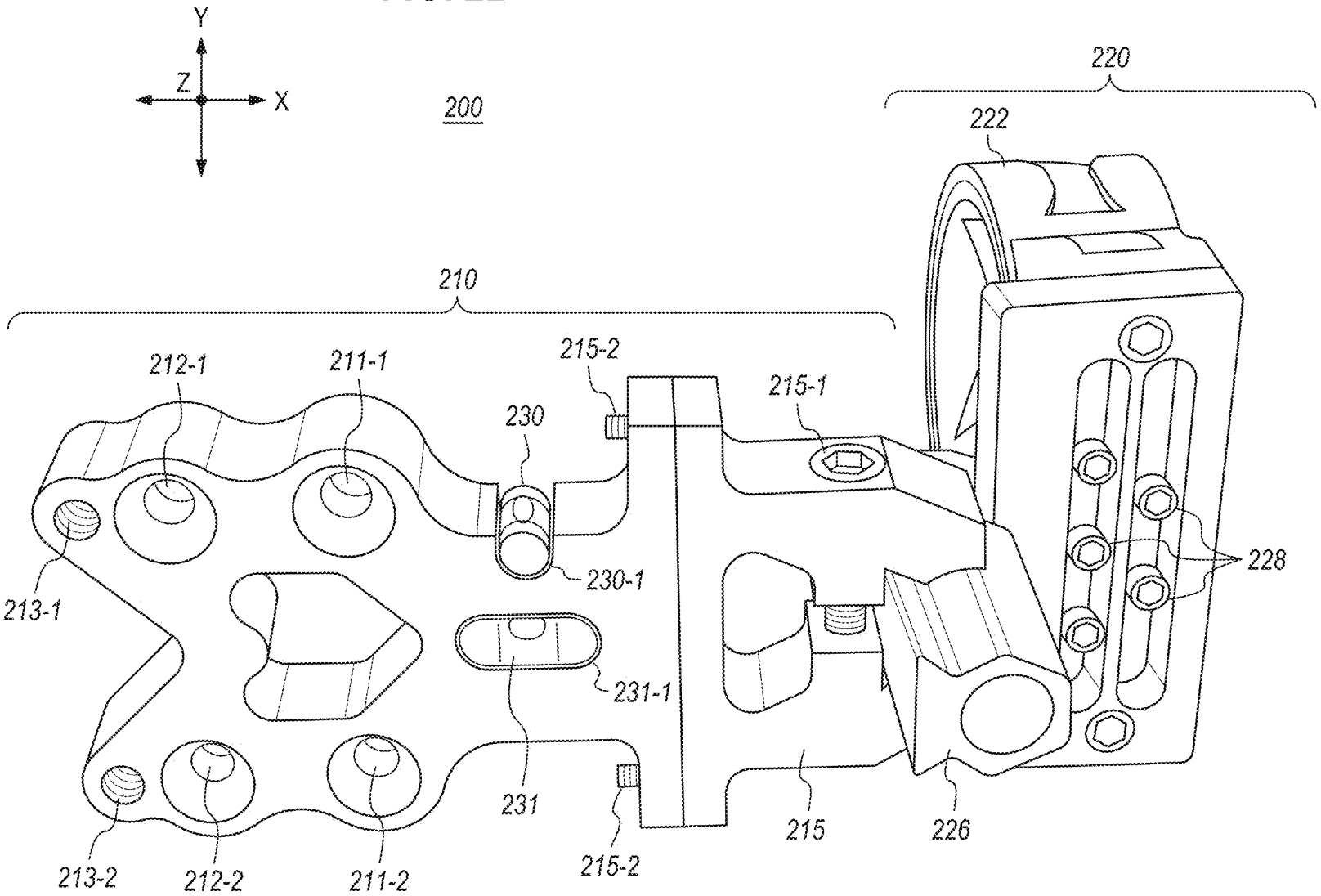
Figure 2C:
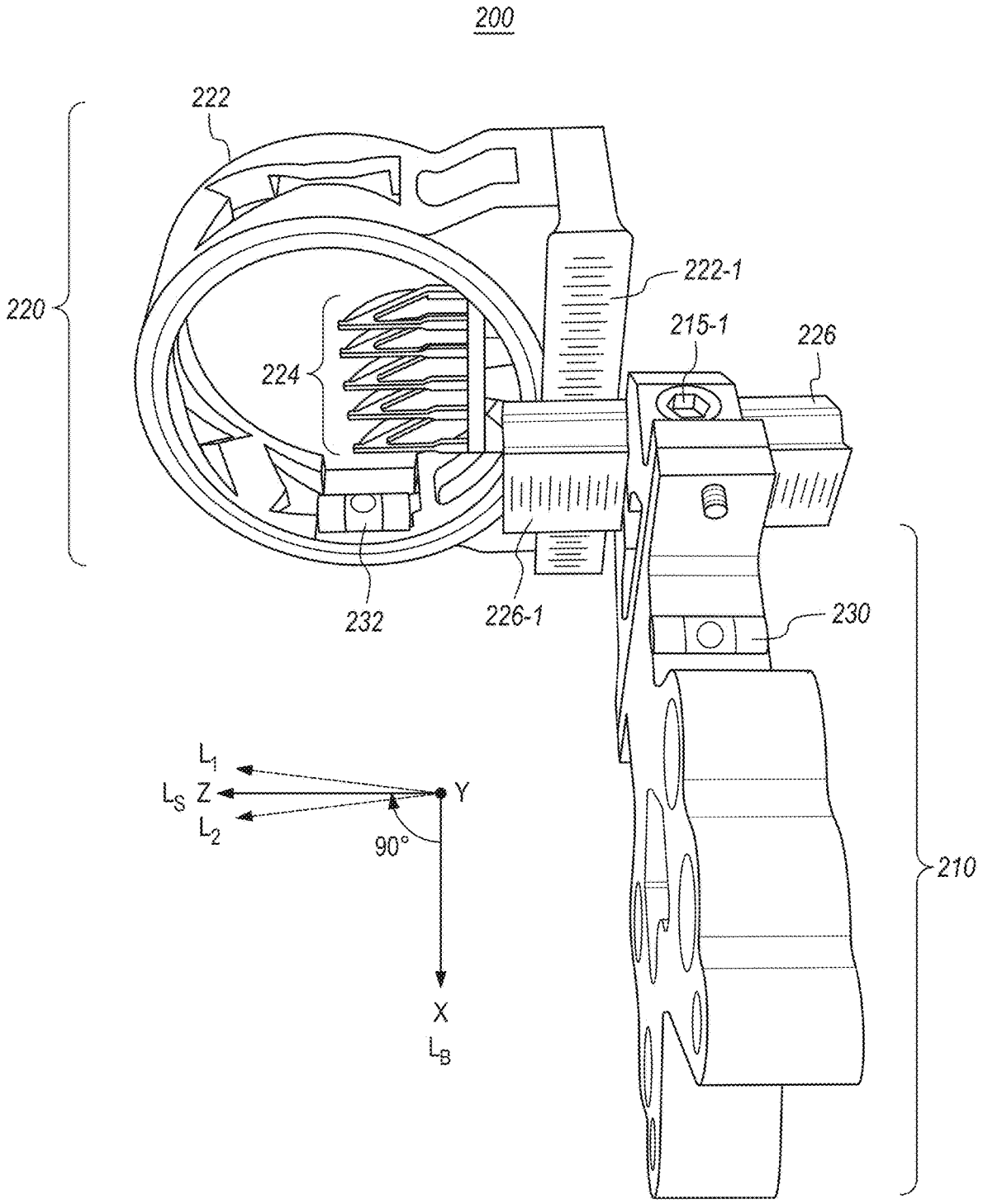

For example, FIGS. 2A, 2B, and 2C are perspective views of a bow sight device 200 with one or more integrated level devices, according to an exemplary embodiment of the disclosure. Referring collectively to FIGS. 2A, 2B, and 2C, the bow sight device 200 comprises a mounting bracket 210 and a sight housing 220 (alternatively referred to as sight head) which is adjustably connected to the mounting bracket 210. The mounting bracket 210 comprises a first set of mounting holes 211-1 and 211-2, a second set of mounting holes 212-1 and 212-2, a third set of mounting holes 213-1 and 213-2, a clamp element 215, a first integrated level device 230, and a second integrated level device 231. The sight housing 220 comprises a sight window 222 (alternatively, sight aperture), a plurality of sight pins 224 disposed within the sight window 222, a slidable bracket 226, sight pin adjustment screws 228, and a level device 232 that is disposed at a base of the sight window 222.

The mounting bracket 210 is utilized to mount the bow sight device 200 to a bow riser using either (i) the first set of mounting holes 211-1 and 211-2 or (ii) the second set of mounting holes 212-1 and 212-2, which allows the sight housing 220 to be disposed on one of two different horizontal distances (e.g., X-direction) from the bow riser. The first set of mounting holes 211-1 and 211-2 and the second set of mounting holes 212-1 and 212-2 are configured to be aligned with industry standard threaded mounting holes that are drilled into a bow riser for mounting a bow sight device to the bow riser. For a first mounting position, threaded bolts are inserted through the first set of mounting holes 211-1 and 211-2 and screwed into the threaded mounting holes of the bow riser. Alternatively, for a second mounting position, threaded bolts are inserted through the second set of mounting holes 212-1 and 212-2 and screwed into the threaded mounting holes of the bow riser. In some embodiments, the third set of mounting holes 213-1 and 213-2 are utilized for mounting a bow accessory such as a bow quiver to the mounting bracket 210.

The clamp element 215 of the mounting bracket 210 is configured to slidably engage the slidable bracket 226 of the sight housing 220. The clamp element 215 comprises a locking screw 215-1 which is used to (i) tighten the clamp element 215 to either fixedly secure the slidable bracket 226 in a desired position, or (ii) loosen the clamp element 215 to allow the slidable bracket 226 to be adjustably moved (e.g., along the Z-axis) into a desired position. As shown in FIG. 2C, the slidable bracket 226 comprises a series of alignment marks 226-1 which are used as a guide to incrementally adjust the horizontal position (e.g., along the Z-axis direction) of the sight window 222 left or right, which provides a windage adjustment mechanism (e.g., essentially to dial in a wind offset into the sight window 222) to compensate for wind. As further shown in FIG. 2C, the sight window 222 comprises a series of alignment marks 222-1 which are used as a guide to incrementally adjust the vertical position (e.g., along the Y-axis direction) of the sight window 222 up or down, which provides an elevation adjustment mechanism to compensate for elevation when shooting an arrow.

In some embodiments, the clamp element 215 is screwed to the main body of the mounting bracket 210 using screws 215-2. This allows the clamp element 215 to be removably attached to the main body of the mounting bracket 21, wherein the clamp element 214 comprises a modular component which can have different structural configurations to slidably interface with other slide bars of other sight housing devices.

As shown in FIG. 2C, in an exemplary embodiment, the bow sight device 200 comprises a multi-pin sighting device where the plurality of sight pins 224 in the sight window 222 comprise five (5) sight pins. The different sight pins correspond to different distances. For example, in the exemplary embodiment shown in FIG. 2C, the 5 sight pins may correspond to 20, 30, 40, 50, and 60 yards, respectively, where the upper most sight pin corresponds to 20 yards, and the lower most sight pin corresponds to 60 yards. In other embodiments, the sight window 222 may have 7 sight pins, 3 sight pins, or just one sight pin, as desired. The different sight pins are often different colors or built with fiber-optics for visibility, which allows an archer to more easily differentiate the different pins/distances. At full draw, an archer will align a target at a given distance with a corresponding sight pin for aiming.

In some embodiments, the level devices 230, 231, and 232 of the bow sight device 200 comprises bubble level devices. The level device 230 is disposed in a retaining cavity/channel 230-1 that is formed on an upper surface of the mounting bracket 210. The level device 231 is disposed in a rounded rectangular-shaped cavity 231-1 formed in a sidewall surface of the mounting bracket 210. In some embodiments, the rounded rectangular-shaped cavity 231-1 is formed on one sidewall surface of the mounting bracket 210 and not exposed on the opposite sidewall surface of the mounting bracket 210. The level device 232 is fixedly attached to a bottom region of the sight window 222. In some embodiments, the bubble level devices 230 and 232 are tubular-shaped bubble levels. On the other hand, in some embodiments, the bubble level device 231 has a rounded rectangular-shaped profile.

Figure 3A:
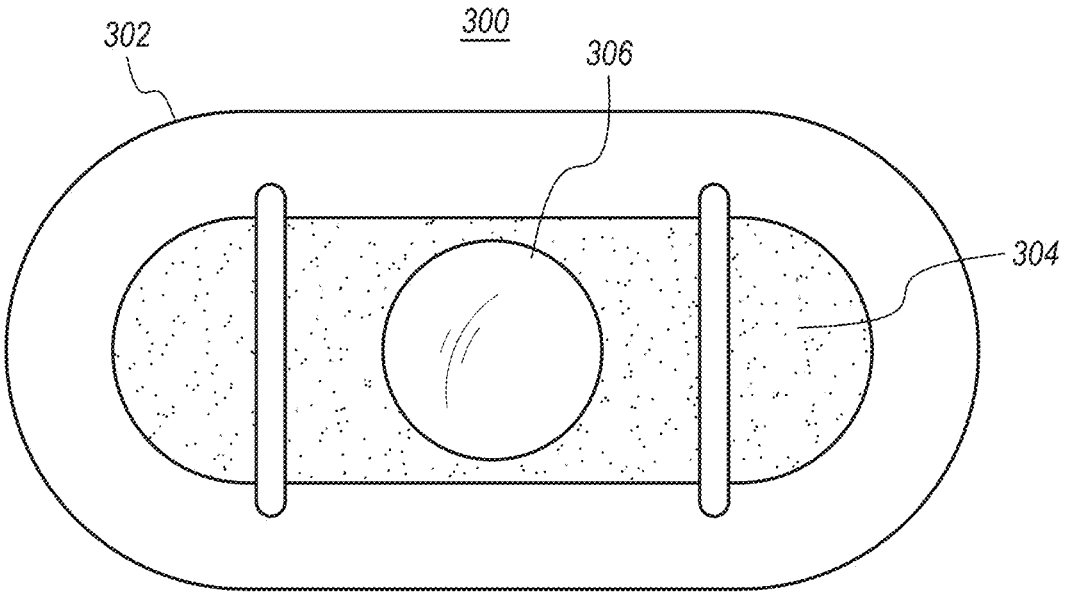
FIGS. 3A and 3B illustrate a level device which can be implemented with a bow sight device, according to an exemplary embodiment of the disclosure.
Figure 3B:
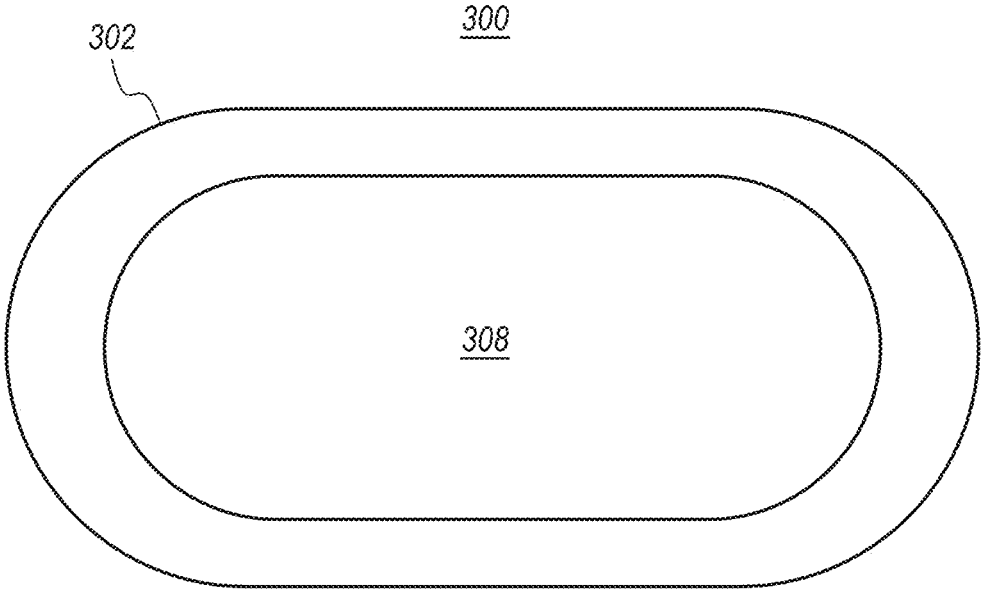

For example, FIGS. 3A and 3B illustrate a level device which can be implemented with a bow sight device, according to an exemplary embodiment of the disclosure. In particular, FIGS. 3A and 3B illustrate bubble level device 300 having a rounded rectangular-shaped profile, which is an exemplary embodiment of the bubble level device 231 shown in FIGS. 2A, 2B, and 2C. FIG. 3A illustrates a top view of the rounded rectangular-shaped bubble level device 300, which shows that the bubble level device 300 comprises an outer shell 302 with a rounded rectangular-shaped profile, and an inner cavity 304 which is incompletely filled with a liquid (e.g., colored alcohol) leaving a bubble 306 in the inner cavity 304. FIG. 3B illustrates a bottom view of the rounded rectangular-shaped bubble level device 300, which shows that the bubble level device 300 comprises planar bottom surface with an opaque capping layer 308 which encloses the inner cavity 304 and maintains the liquid within the inner cavity 304. The planar bottom surface of the bubble level device 300 is disposed on a bottom recessed surface of the rounded rectangular-shaped cavity 231-1 that is formed in the sidewall surface of the mounting bracket 210 of FIGS. 2A-2C.

Figure 4A:
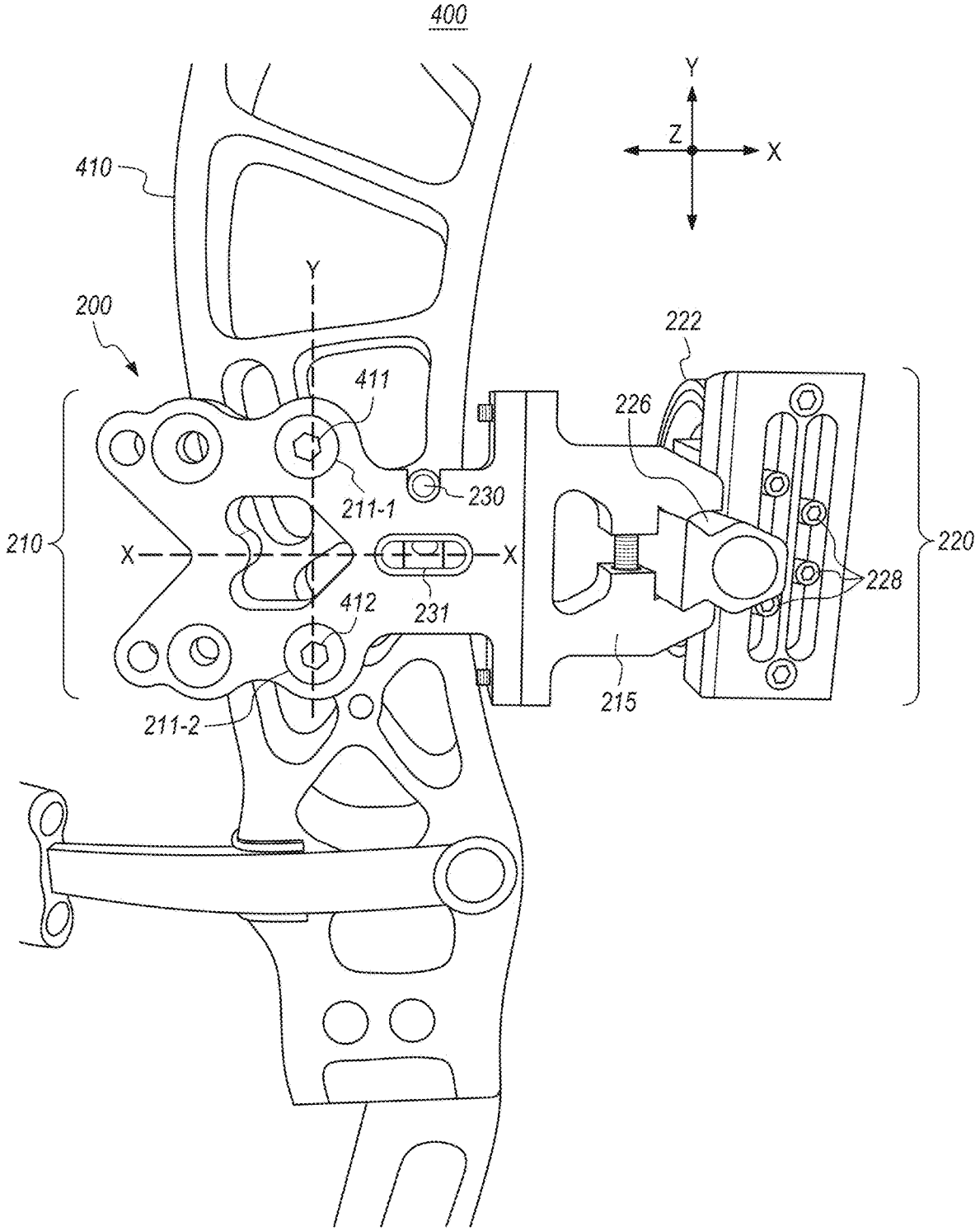
FIG. 4A is a perspective view of an apparatus comprising a bow riser and bow sight device mounted to the bow riser, wherein the bow sight device comprises one or more integrated level devices to facilitate bow tuning operations, adjustments of the bow sight device, and installation of other bow accessories, according to an exemplary embodiment of the disclosure.
Figure 4B:
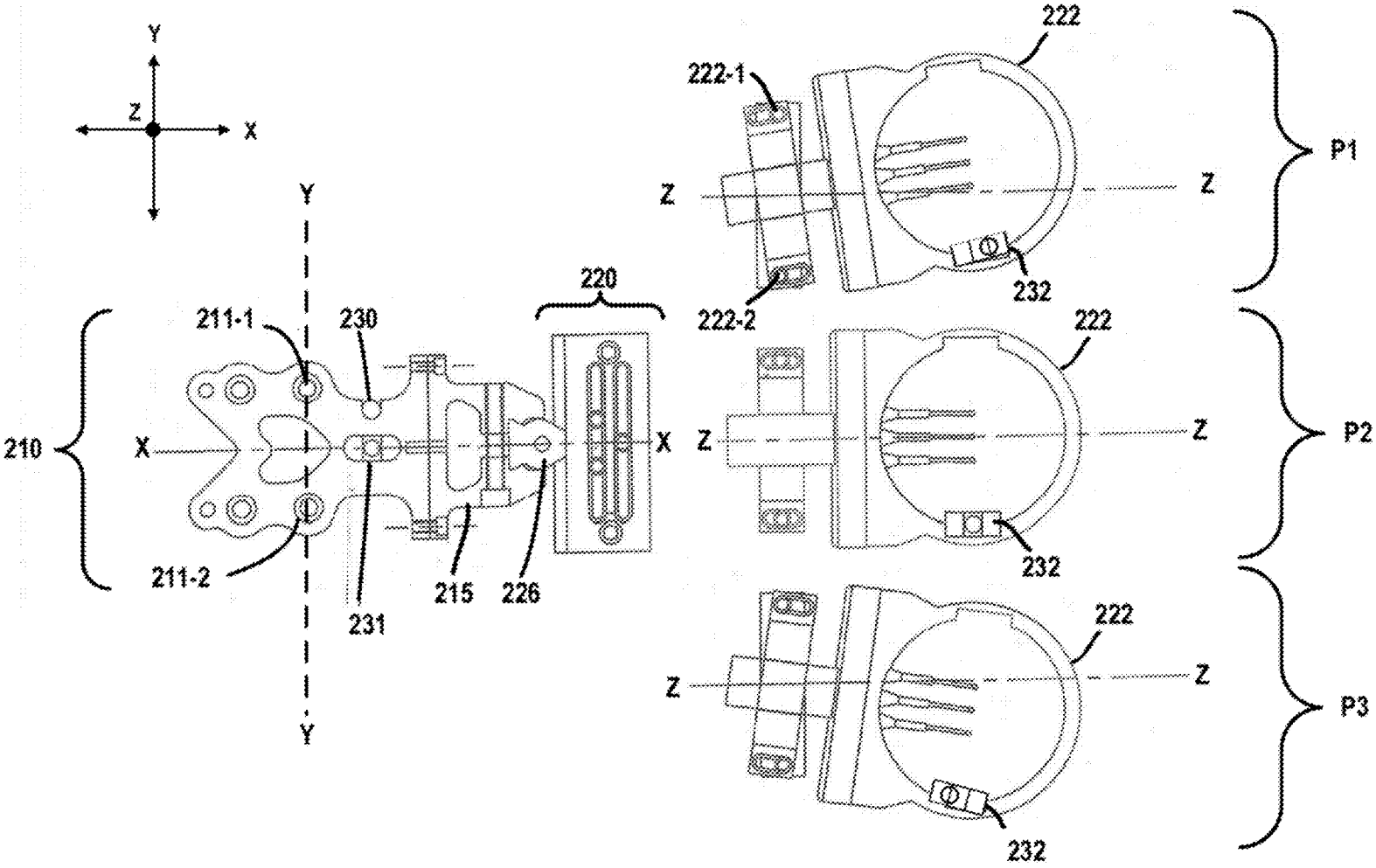
FIG. 4B schematically illustrates a method for adjusting a bow sight device when mounted to a bow riser, according to an exemplary embodiment of the disclosure.

In some embodiments, the level devices 230, 231, and 232 of the bow sight device 200 are utilized to position a bow riser in a true vertically level position, and aid in performing bow tuning operations for tuning an archery bow, such as determining a nocking point on the bow string, making bow sight adjustments (first, second, and third axis adjustments), and installing other bow accessories such as installing an arrow rest on a bow riser, etc., the details of which will be explained in detail below in conjunction with FIGS. 4A and 4B.

To facilitate such bow tuning operations, referring to FIG. 2B, the first set of mounting holes 211-1 and 211-2 of the mounting bracket 210 are formed in vertical alignment in a Y-direction, wherein the first set of mounting holes 211-1 and 211-2 are aligned along a longitudinal axis A-A of the bow riser (e.g., as shown in FIG. 1) when the bow sight device 200 is mounted to the bow riser using the first set of mounting holes 211-1 and 211-2. Similarly, the second set of mounting holes 212-1 and 212-2 of the mounting bracket 210 are formed in vertical alignment in a Y-direction, wherein the second set of mounting holes 212-1 and 212-2 are aligned along the longitudinal axis A-A of the bow riser (FIG. 1), when the bow sight device 200 is mounted to the bow riser using the second set of mounting holes 212-1 and 212-2. As further shown in FIG. 2B, the retaining cavity 231-1 and corresponding bubble level device 231 are horizontally disposed along a first direction (X-axis direction) which is orthogonal to the Y-axis and Z-axis directions. Moreover, the retaining cavity 230-1 and bubble level device 230 are horizontally disposed along a second direction (Z-axis direction) which is orthogonal to the Y-axis and X-axis directions.

With the exemplary structural configuration of the bow sight device 200 as shown in FIGS. 2A-2C, each level device 230, 231, and 232 has a specific use for tuning, wherein such uses are independent of each other. For example, as explained in further detail below, the level device 231 on the sidewall surface of the mounting bracket 210 is utilized (independent of the level devices 230 and 232) to set a nocking point on a bow string. In addition, the level device 231 is utilized (independent of the level devices 230 and 232) to adjust a "first axis" of the bow sight device 200. Further, the level device 230 is utilized (independent of the level device 231) to adjust a "second axis" and a "third axis" of the bow sight device, using techniques as will now be described in further detail in conjunction with FIGS. 4A and 4B.

FIG. 4A is a perspective view of an apparatus comprising a bow riser and a bow sight device mounted to the bow riser, wherein the bow sight device comprises one or more integrated level devices to facilitate bow tuning operations, adjustments of the bow sight device, and installation of other bow accessories, according to an exemplary embodiment of the disclosure. In particular, FIG. 4 illustrates an apparatus 400 comprising a bow riser 410 having the exemplary bow sight device 200 (of FIGS. 2A-2C) mounted thereon. In the exemplary configuration shown in FIG. 4A, the bow sight device 200 is mounted to the bow riser 410 using first and second threaded bolts 411 and 412 which are inserted through the first set of mounting holes 211-1 and 211-2 of the mounting bracket 210 and screwed into standard mounting holes that are drilled into the bow riser 410 for attaching the bow sight device 200 to the bow riser 410.

With the structural configuration shown in FIG. 4A, as noted above, the bubble level device 231 on the sidewall surface of the mounting bracket 210 can be utilized (independent of the level devices 230 and 232) to set a nocking point on a bow string using a tuning process as follows. Initially, the bow riser 410 can be placed into a position where the bubble level device 231 indicates a level horizontal orientation of the X-axis. With the horizontal X-axis in a level orientation, the nocking point on the bow string can be determined irrespective of whether or not the bubble level device 230 on the upper surface of the mounting bracket 210 indicates a level orientation of the Z-axis. In other words, the nocking point on the bow string can be determined irrespective of whether the bubble level device 230 indicates a horizontal level orientation of the Z-axis.

Assuming that an arrow rest device is already installed on the bow riser 410, with the bubble level device 231 indicating that horizontal X-axis is level, an arrow is placed in the arrow rest device and a nock element at the end of the arrow shaft is placed onto the bow string. A hand-held level device (e.g., custom arrow level tool) is then placed on the arrow shaft, and the nock end of the arrow shaft is moved up or down on the bow string until the handheld arrow level device indicates that the arrow shaft is level. The nocking point will be the point on the bow string where the nock element of the arrow is positioned when the arrow shaft is horizontally level in the same horizontal X-axis orientation as indicated by the bubble level device 231 on the sidewall of the mounting bracket 210. Again, it is to be noted that the nocking point can be accurately determined irrespective of whether the bow sight device 200 is level along the Z-axis direction.

It is to be appreciated that since the bow sight device 200 remains mounted to the bow riser, after some period of time of shooting arrows, an archer can recheck the arrow nocking position to make sure it has not moved. The nocking point can be rechecked using the same process as discussed above in conjunction with the integrated bubble level device 231 on the sidewall of the mounting bracket 210 of the bow sight device 200.

Furthermore, as noted above, the level device 231 is utilized (independent of the level devices 230 and 232) to adjust a "first axis" of the bow sight device 200. In the exemplary configuration of FIG. 4A, the "first axis" adjustment of the bow sight device 200 is achieved when the bow sight device 200 is mounted to the bow riser 410 and the bow riser 410 is placed into a position where the bubble level device 231 indicates a level horizontal orientation of the X-axis. In this structural configuration, the frame of the sight window 222 is assumed to be straight up and down, i.e., the top/bottom portion of the sight window 222 does not lean toward/away or away/toward the archer. In other embodiments, when the sight housing 220 includes specific adjustment screws to adjust the lean of the sight window 222, when the bow sight device 200 is mounted to the bow riser 410 and the bow riser 410 is placed into a position where the bubble level device 231 indicates a level horizontal orientation of the X-axis, a handheld level device (e.g., bullet level) can be placed against the face of the sight window 222 to determine if the sight window 222 is vertically level. If not, the first axis adjustment screws or mechanism can be used to adjustably move the sight window 222 into a vertical position with the X-axis fixed in the horizontal level position as indicated by the bubble level device 231.

Furthermore, as noted above, the level device 230 is utilized (independent of the level device 231) to adjust a "second axis" and a "third axis" of the bow sight device 200. For example, in the exemplary configuration of FIG. 4A, the "second axis" adjustment of the bow sight device 200 is achieved when the bow sight device 200 is mounted to the bow riser 410 and (i) the bow riser 410 is placed into a position where the bubble level device 230 on the upper surface of the mounting bracket 210 indicates a level horizontal orientation of the Z-axis and (ii) the sight window 222 is positioned with the bubble of the level device 232 at the bottom of the sight window 222 matching the bubble of the level device 230 on the mounting bracket 210.

For example, FIG. 4B schematically illustrates a method for adjusting the second axis of the bow sight device 200 when mounted to the bow riser 410, according to an exemplary embodiment of the disclosure. In FIG. 4B, it is assumed that the bow sight device 200 is mounted to the bow riser 410 and that the bow riser 410 is positioned such that the bubble levels 231 and 230 indicate horizontal level orientations in both the X-axis and Z-axis directions. FIG. 4B illustrates three different exemplary positions P1, P2, and P3 of the sight window 222 with the bubble level device 230 on the mounting bracket 210 indicating a horizontal level orientation in the Z-axis direction. The first and third positions P1 and P3 of the sight window 222 as shown in FIG. 4B are not level, as indicated by the bubble level device 232 at the bottom of the sight window 222. On the other hand, the second position P2 of the sight window 222 is level, as indicated by the bubble level device 232 at the bottom of the sight window 222. In the second position P2, it is assumed that the level indication of the bubble level device 232 matches the level indication of the bubble level device 230 on the mounting bracket 210.

As schematically illustrated in FIG. 4B, the sight window 222 comprises sight window adjustment screws 222-1 and 222-2 which can be loosened to adjustably move the sight window 222 from the first position P1 or the third position P3 to the second position P2 to achieve the second axis adjustment. At the second position P2, where the sight window 222 is positioned in a level orientation along the horizontal Z-axis, the sight window adjustment screws 222-1 and 222-2 are tightened to maintain the sight window 222 in the second position P2.

It is to be noted that FIG. 2C illustrates an exemplary configuration in which the level indication of the bubble level device 232 (which is disposed at the bottom of the sight window 222) matches the level indication of the bubble level device 230 (which is disposed on the upper side surface of the mounting bracket 210), thereby providing an indication of a proper "second axis" adjustment of the bow sight device 200. Furthermore, FIG. 2C illustrates a "third axis" adjustment of the bow sight device 200. A "third axis" adjustment of the bow sight device 200 is performed following the "second axis" adjustment, to ensure that a longitudinal axis of the sight housing 220 is essentially perpendicular (orthogonal) to a longitudinal axis of the mounting bracket 210. Indeed, while the second axis adjustment process results in the longitudinal axis of the sight housing 220 (or sight window 220) being level in the X-Z plane, there can be an instance where the longitudinal axis of the sight housing 220 (or sight window 220) is not perpendicular to the plane (X-Y plane) of the mounting bracket 210.

In particular, FIG. 2C illustrates an exemplary X-Y-Z coordinate system in which the X-axis and the Z-axis are orthogonal (i.e., 90 degree). The X-axis is assumed to be aligned with a longitudinal axis $L_B$ of the mounting bracket 210, and the Z-axis is assumed to be aligned with the longitudinal axis $L_S$ of the sight housing 220 (or the sight window 222) when there is a proper "third axis" alignment. On the other hand, there can be a circumstance when the longitudinal axis $L_S$ of the sight housing 220 (or the sight window 222) is aligned to an axis $L_1$ in which case the longitudinal axis $L_S$ of the sight housing 220 (or the sight window 222) is disposed at an angle of greater than 90 degrees in relation to the X-axis and longitudinal axis $L_B$ of the mounting bracket 210, as graphically illustrated in FIG. 2C. Furthermore, there can be a circumstance when the longitudinal axis $L_S$ of the sight housing 220 (or the sight window 222) is aligned to an axis $L_2$ in which case the longitudinal axis $L_S$ of the sight housing 220 (or the sight window 222) is disposed at an angle of less than 90 degrees in relation to the X-axis and longitudinal axis $L_B$ of the mounting bracket 210, as graphically illustrated in FIG. 2C In either circumstance, when shooting an arrow at a target on flat ground, the bubble level device 232 at the bottom of the sight window 222 will read level assuming the second axis has been properly adjusted as discussed above. On the other hand, when shooting at a target uphill or downhill, when the bow is aimed uphill or downhill, the bubble level device 232 at the bottom of the sight window 222 will not read level, notwithstanding that the second axis has been properly adjusted. By way of specific example, assume that the longitudinal axis $L_S$ of the sight window 222 is angled away and aligned to the axis $L_1$. As the bow is aimed uphill, the larger angle (greater than 90 degrees) on the third axis will take effect and the bubble of the bubble level device 232 will move to the left of center (for a right-handed shooter), indicating improper third axis alignment. Further, as the bow is aimed downhill, the larger angle (greater than 90 degrees) on the third axis will take effect and the bubble of the bubble level device 232 will move to the right of center (for a right-handed shooter), indicating an improper third axis alignment. The similar, but opposite bubble level readings of the bubble level device 232 occur when the longitudinal axis $L_S$ of the sight window 222 is angled toward the shooter, e.g., aligned to the axis $L_2$ as shown in FIG. 2C.

In view of the above, a third axis alignment is facilitated by use of the bubble levels 230 and 232. In particular, once the second axis alignment process is performed, the third axis alignment can be performed by aiming the bow downward (or upward) while keeping the bow riser 410 positioned such that the bubble level device 230 on the top of the mounting bracket 210 reads level. If the reading of the bubble level device 232 on the bottom of the sight window 222 remains level while the bow is being aimed downward or upward, then third axis alignment is achieved. On the other hand, if the reading of the bubble level device 232 on the bottom of the sight window 222 does not remain level while the bow is being aimed downward or upward, then the angular orientation of the sight window 222 or sight housing 220 can be adjusted using a third axis adjustment mechanism of the bow sight device 200 (not specifically shown) to rotate the sight window 222 into a proper angular position in which the longitudinal axis $L_S$ of the sight housing sight window 222 is disposed orthogonal to the longitudinal axis $L_B$ of the mounting bracket 210.

It is to be noted that the exemplary bow tuning techniques as disclosed herein can be performed using a bow leveling tuning system such as disclosed in U.S. Pat. No. 5,344,110, entitled Holder Apparatus For Positioning Archery Bow Relative To Orthogonal Axes, to adjustably position a bow riser in a vertical level orientation and fixedly hold the bow rise in place in a vertical level orientation while being tuned/accessorized. Commercially available products, which are based on the structural embodiments disclosed in U.S. Pat. No. 5,344,110, are currently manufactured and sold by R.S. Bowvise Inc. These commercially available products are currently sold under the trade name R.S. BOW-VISE™. These commercially available bow leveling tuning products are configured to securely hold an archery bow in an upright position, while providing flexibility in tipping the archery bow backward and forward or side to side and locking in at any angle. These tuning devices enable hands free mounting of accessories to archery bows, and well as micro adjustment capabilities for nock alignment and bow sight installation.

It is to be appreciated that the integrated level devices 230 and 231 of the bow sight device 200 can be used to position a bow riser in a level vertical orientation and allow an individual to tune the bow or otherwise install other accessories (such as an arrow rest) on the bow riser with the bow riser fixed in a level position. For example, with a bow riser disposed in a proper level vertical orientation using the bubble level devices 230 and 231 of the bow sight device 200, an arrow rest device can be mounted to the riser and leveled in a horizontal orientation (X-axis direction) using a handheld level device.

Figure 5A:
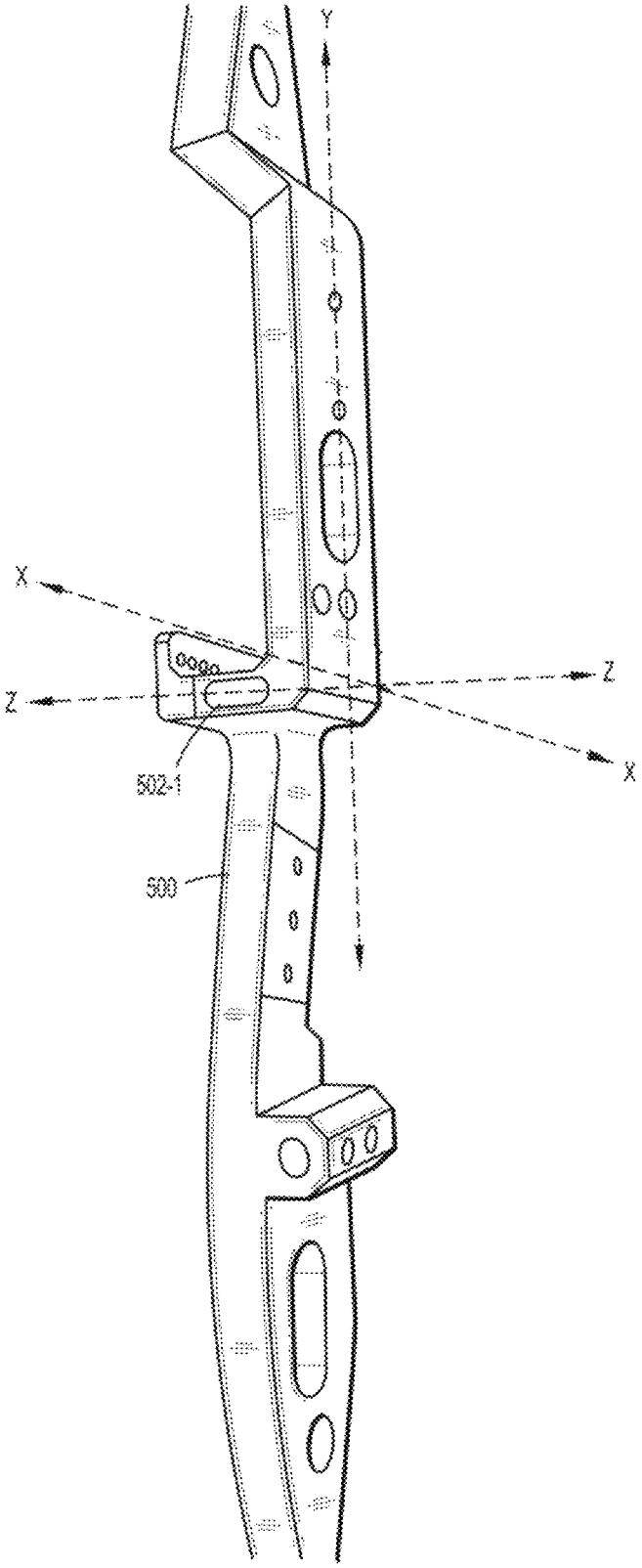
FIG. 5A is a perspective view of a bow riser having an integrated level device, according to an exemplary embodiment of the disclosure.

In other embodiments of the disclosure, rather than using multiple bubble level devices on the bow sight device 200 to achieve level orientations in the X-axis, Y-axis, and Z-axis directions, bow risers can be fabricated with integrated level devices (e.g., integrated bubble levels) to assist with leveling and tuning. For example, FIG. 5A is a perspective view of a bow riser 500 having an integrated level device, according to an exemplary embodiment of the disclosure. More specifically, as shown in FIG. 5A, the bow riser 500 includes an integrated bubble level device 502-1 which is disposed within a cavity of the bow riser 500, or which is otherwise fixedly mounted to the body of the bow riser 500. In the exemplary embodiment of FIG. 5A, the integrated bubble level device 502-1 is utilized to enable leveling in the Z-axis direction.

In this configuration, the integrated bubble level device 502-1 performs the same or similar functions as the integrated bubble level device 230 of the exemplary bow sight device 200, as discussed above. Moreover, in this configuration, an exemplary bow sight device can be fabricated with a single bubble level device (e.g., bubble level device 231) to enable leveling in the X-axis direction, while the integrated bubble level device 502-1 of the bow riser 500 is used to enable leveling in the Z-axis direction. As such, the integrated bubble level 502-1 of the bow riser 500, the integrated bubble level on the bow sight mounting bracket (e.g., bubble level device 231), and the integrated bubble level device 232 on the bottom of the sight window 222 can be utilized to perform the same or similar tuning techniques as discussed above.

Figure 5B:
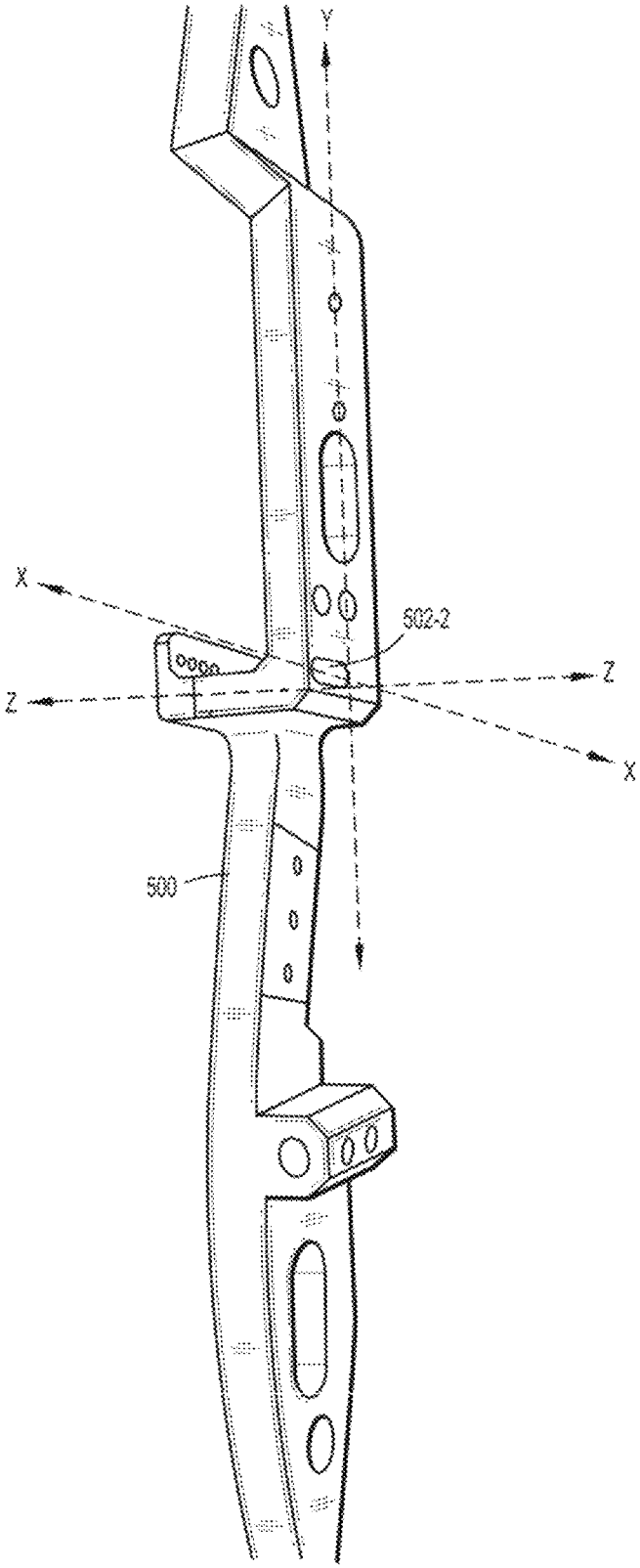
FIG. 5B is a perspective view of a bow riser having an integrated level device, according to another exemplary embodiment of the disclosure.

Next, FIG. 5B is a perspective view of a bow riser having an integrated level device, according to another exemplary embodiment of the disclosure. More specifically, as shown in FIG. 5B, the bow riser 500 includes an integrated bubble level device 502-2 which is disposed within a cavity of the bow riser 500, or which is otherwise fixedly mounted to the body of the bow riser 500. In the exemplary embodiment of FIG. 5B, the integrated bubble level device 502-2 is utilized to enable leveling in the X-axis direction.

In this configuration, the integrated bubble level device 502-2 performs the same or similar functions as the integrated bubble level device 231 of the exemplary bow sight device 200, as discussed above. Moreover, in this configuration, an exemplary bow sight device can be fabricated with a single bubble level device (e.g., bubble level device 230) to enable leveling in the Z-axis direction, while the integrated bubble level device 502-2 of the bow riser 500 is used to enable leveling in the X-axis direction. As such, the integrated bubble level 502-2 of the bow riser, the integrated bubble level on the bow sight mounting bracket (e.g., bubble level device 230), and the integrated bubble level device 232 on the bottom of the sight window 222 can be utilized to perform the same or similar tuning techniques as discussed above.

Although exemplary embodiments of the present disclosure have been described herein with reference to the accompanying figures, it is to be understood that the disclosure is not limited to those precise embodiments, and that various other changes and modifications may be made therein by one skilled in the art without departing from the scope of the appended claims.

What is claimed is:

1. A bow sight device, comprising:

a mounting bracket configured for attachment of the bow sight device to a bow riser; and a sight housing adjustably connected to the mounting bracket, wherein:

the mounting bracket comprises a first level device and a second level device;

the sight housing comprises a third level device;

the first level device is utilized to level the bow riser in a first direction, when the bow sight device is attached to the bow riser, and to adjust a first axis of the bow sight device which comprises adjusting a vertical lean of the sight housing;

the second level device is utilized to level the bow riser and the sight housing in a second direction which is orthogonal to the first direction, when the bow sight device is attached to the bow riser, and to adjust a second axis of the bow sight device which comprises adjusting a position of the sight housing so that a level indication of the third level device matches a level indication of the second level device in the second direction; and the second level device and the third level device are configured to enable a user to concurrently view the second and third level devices to adjust a third axis of the bow sight device which comprises adjusting a longitudinal axis of the sight housing to be orthogonal to the mounting bracket.

2. The bow sight device of claim 1, wherein;

the mounting bracket comprises a first through hole and a second through hole aligned along a third direction which is orthogonal to the first direction and to the second direction;

the first and second through holes are configured to insertably receive mounting bolts for mounting the bow sight device to the bow riser; and the third direction is aligned with a central longitudinal axis of the bow riser.

3. The bow sight device of claim 1, wherein the mounting bracket comprises a cavity formed in a side surface thereof, and a channel formed in a top surface thereof, wherein the first level device is disposed in the cavity and the second level device is disposed in the channel.

4. The bow sight device of claim 3, wherein the first level device and the second level device are bubble levels.

5. The bow sight device of claim 4, wherein the first level device comprises a planar bottom surface that is bonded to a bottom surface of the cavity.

6. The bow sight device of claim 1, wherein:

the sight housing comprises a sight window having the third level device; and adjusting the first axis of the bow sight device comprises adjusting the vertical lean of the sight window so that a vertical axis of the sight window is orthogonal to the first direction.

7. The bow sight device of claim 6, wherein the second level device and the third level device are configured to adjust the third axis of the bow sight device by adjusting the longitudinal axis of the sight housing to be orthogonal to the mounting bracket, when the bow sight device is attached to the bow riser, so that a level indication of the third level device matches a second indication of the second level device when the bow riser with the bow sight device attached is pointed in either a downward shooting direction or an upward shooting direction.

8. An apparatus, comprising:

a bow riser comprising a first level device; and a bow sight device mounted to the bow riser, the bow sight device comprising a mounting bracket attached to the bow riser, a sight housing adjustably connected to the mounting bracket, a second level device disposed on the mounting bracket, and a third level device disposed on the sight housing, wherein:

the first level device, the second level device, and the third level device are configured to enable a first axis adjustment, a second axis adjustment, and a third axis adjustment of the bow sight device mounted to the bow riser;

the first axis adjustment comprises a vertical lean adjustment of the sight housing;

the second axis adjustment comprises a horizontal level adjustment of the sight housing; and the third axis adjustment comprises a longitudinal axis adjustment of the sight housing to position the longitudinal axis orthogonal to the mounting bracket.

9. The apparatus of claim 8, wherein:

the first level device on the bow riser is oriented in a first direction; and the second level device and the third level device are oriented in a second direction, which is orthogonal to the first direction.

10. The apparatus of claim 9, wherein the mounting bracket comprises a channel formed in a top surface thereof, wherein the second level device is disposed in the channel.

11. The apparatus of claim 9, wherein the third level device is utilized to level the sight housing in the second direction in conjunction with the second level device to thereby achieve the second axis adjustment when a level indication of the third level device matches a level indication of the second level device in the second direction.

12. The apparatus of claim 8, wherein:

the second level device is oriented in a first direction the first level device and the third level device are oriented in a second direction, which is orthogonal to the first direction.

13. The apparatus of claim 12, wherein:

the mounting bracket comprises a cavity formed in a side surface thereof; and the second level device is disposed in the cavity.

14. The apparatus of claim 13, wherein:

the mounting bracket comprises a first through hole and a second through hole aligned along a third direction, which is orthogonal to the first direction and to the second direction;

the first and second through holes are configured to insertably receive mounting bolts for mounting the bow sight device to the bow riser; and the third direction is aligned with a central longitudinal axis of the bow riser.

15. The apparatus of claim 12, wherein the third level device is utilized to level the sight housing in the second direction in conjunction with the first level device to thereby achieve the second axis adjustment when a level indication of the third level device matches a level indication of the first level device in the second direction.

16. The apparatus of claim 9, wherein the first level device disposed on the bow riser is utilized to level the mounting bracket of the bow sight device in the first direction and thereby achieve the first axis adjustment of the bow sight device by adjusting the vertical lean of the sight housing.

17. The apparatus of claim 12, wherein the first level device disposed on the mounting bracket is utilized to level the mounting bracket of the bow sight device in the first direction to thereby achieve the first axis adjustment of the bow sight device by adjusting the vertical lean of the sight housing.

18. A bow sight device, comprising:

a mounting bracket configured for attachment of the bow sight device to a bow riser;

a sight housing adjustably connected to the mounting bracket;

a first level device disposed on the mounting bracket; and a second level device disposed on the sight housing, wherein:

the first and second level devices are oriented in first direction; and the first and second level device are configured to enable multiple axis adjustments of the bow sight device when mounted to the riser, the multiple axis adjustments including (i) adjusting a longitudinal axis of the sight housing to be horizontally level in the first direction, and (ii) adjusting the longitudinal axis of the sight housing to be orthogonal to the mounting bracket.

19. The bow sight device of claim 18, wherein:

the first level device is disposed on a top surface of the mounting bracket; and the second level device is disposed within a sight window of the sight housing.

20. The bow sight device of claim 18, further comprising a third level device disposed on the mounting bracket and oriented in a second direction, which is orthogonal to the first direction.

* * * * *